US007753131B2

(12) United States Patent
Brooks

(10) Patent No.: US 7,753,131 B2
(45) Date of Patent: Jul. 13, 2010

(54) HIGH TEMPERATURE PACKER AND METHOD

(75) Inventor: Robert T. Brooks, Houston, TX (US)

(73) Assignee: Tam International, Inc., Houston, TX (US)

( * ) Notice: Subject to any disclaimer, the term of this patent is extended or adjusted under 35 U.S.C. 154(b) by 98 days.

(21) Appl. No.: 12/195,180

(22) Filed: Aug. 20, 2008

(65) Prior Publication Data

US 2010/0044028 A1 Feb. 25, 2010

(51) Int. Cl.
*E21B 33/12* (2006.01)

(52) U.S. Cl. ..... 166/387; 166/196

(58) Field of Classification Search ..... 166/387, 166/196

See application file for complete search history.

(56) References Cited

U.S. PATENT DOCUMENTS

| | | | | |
|---|---|---|---|---|
| 2,838,005 | A * | 6/1958 | Garrett et al. | 417/59 |
| 3,409,085 | A * | 11/1968 | Oliver | 166/134 |
| 4,176,715 | A | 12/1979 | Bigelow et al. | |
| 4,296,806 | A | 10/1981 | Taylor et al. | |
| 4,433,726 | A * | 2/1984 | Preston et al. | 166/118 |
| 4,457,369 | A | 7/1984 | Henderson | |
| 4,479,369 | A | 10/1984 | Sando et al. | |
| 4,548,264 | A | 10/1985 | Manderscheid | |
| 4,665,978 | A | 5/1987 | Luke | |
| 4,709,758 | A | 12/1987 | Preston, Jr. | |
| 4,730,670 | A | 3/1988 | Kim | |
| 5,311,938 | A | 5/1994 | Hendrickson et al. | |
| 5,325,925 | A * | 7/1994 | Smith et al. | 166/387 |
| 5,433,269 | A | 7/1995 | Hendrickson | |
| 6,102,117 | A | 8/2000 | Swor et al. | |
| 6,318,460 | B1 | 11/2001 | Swor et al. | |
| 6,406,028 | B1 | 6/2002 | Kannan | |
| 6,481,497 | B2 | 11/2002 | Swor et al. | |
| 6,742,585 | B1 * | 6/2004 | Braithwaite et al. | 166/196 |
| 6,915,856 | B2 | 7/2005 | Gentry et al. | |
| 7,387,158 | B2 * | 6/2008 | Murray et al. | 166/196 |
| 2007/0163777 | A1 * | 7/2007 | Murray et al. | 166/179 |

* cited by examiner

*Primary Examiner*—Shane Bomar
(74) *Attorney, Agent, or Firm*—Browning Bushman P.C.

(57) ABSTRACT

A high temperature packer (10) force a tubular string in a well, and includes a packer mandrel (12) and an elastomeric packer body (14) positioned circumferentially about the mandrel. An upper packer head (16) and a lower packer head (18) are each positioned about the mandrel and secured to an end of the packer body. A connector (24) axially interconnects at least one of the upper packer head and lower packer head to the packer mandrel, and a temperature responsive member (30) maintains the connector in position to secure the packer head to the mandrel until the temperature in the well rises to a level such that the responsive member yields to allow the connector to release the packer head from the mandrel.

16 Claims, 3 Drawing Sheets

HIGH TEMPERATURE PACKER AND METHOD

FIELD OF THE INVENTION

The present invention relates to high temperature packers and methods of operating high temperature packers. More particularly, the invention relates to a high temperature packer which is positioned on a tubular string but is not damaged by normal axial temperature expansion and contraction of the tubular string.

BACKGROUND OF THE INVENTION

Various types of high temperature packers have been devised, including those disclosed in U.S. Pat. Nos. 6,481,497, 6,318,460, 6,102,117, 5,433,269, 5,311,938, 4,709,758, 4,665,978, 4,584,264, 4,479,369, and 4,296,806. U.S. Pat. No. 6,406,028 discloses a seal stack, and U.S. Pat. No. 6,915,856 discloses a technique for preventing axial movements of downhole tool assemblies.

While the components of a downhole packer may be manufactured for operation at a certain temperature, a significant problem concerning reliable operation of downhole packers involves the packer being axially mounted on a tubular string, which may then be expanded to engage and seal with casing string or the borehole. As the temperature fluctuates considerably downhole due to downhole conditions, thermal expansion and contraction of the tubular string places a high axial force on the packer body, which may result in destruction of the packer sealing elements. One of the techniques to avoid this destructive behavior is to provide a mechanism which axially releases the packer body from a central mandrel, so that elongation and contraction of the tubular string would not adversely affect the packer. U.S. Pat. No. 4,176,715 discloses such a releasing mechanism, and U.S. Pat. Nos. 4,709,758 and 4,730,760 disclose slick joint portions within the packer body, so that axial movement of the tubing string in either direction relative to the set packers is possible.

One of the problems with the above devices is that the packer body is preferably secured at a fixed axial position when run in the well, so that the depth of the set packer will be known. The packer body once set may be released from the tubular string to accommodate thermal expansion, but this operation requires that the operator perform these steps to release from the set packer. This packer releasing operation must be performed reliably and with a minimal of time and expense. Packer bodies which are provided on a slick joint can readily move axially along the slick joint if they are not set in initial position. The position of the packer body relative to the slick joint determines whether the necessary expansion and contraction stroke are able to be achieved before the packer head "tops out" or "bottoms out" with no further stroke possible.

The disadvantages of the prior art are overcome by the present invention and an improved high temperature packer and method are hereinafter disclosed.

SUMMARY OF THE INVENTION

In one embodiment, the high temperature packer is supported on a tubular string in a well, with a packer including a mandrel and an elastomeric packer body positioned circumferentially about the mandrel. An upper packer head and a lower packer head are each positioned about the mandrel and are secured to ends of the packer body. A connector axially interconnects at least one of the upper packer head and lower packer head to the packer mandrel, and a temperature responsive member maintains the connector in position to secure the packer head to the mandrel until the temperature in the well rises to a level such that the temperature responsive member yields to allow the connector to release the connected packer head from the mandrel.

In one embodiment, a method of the invention involves supporting a high temperature packer on a tubular string in a well, and includes providing a packer mandrel secured to the tubular string, and positioning an elastomeric packer body circumferentially about the mandrel. An upper packer head is positioned about the mandrel and secured to the upper end of the packer body, and a lower head is positioned about the mandrel and secured to a lower end of the packer body. The method includes axially interconnecting at least one of an upper packer head and a lower packer head to the packer mandrel, and radially expanding the packer body to seal the annulus about the packer mandrel. A temperature responsive member is provided for maintaining a connector in position to secure the packer head to the mandrel until a temperature in the well rises to a level such that the temperature responsive member yields to allow the connector to release the connected packer head from the mandrel. Accordingly, the packer body and upper and lower packer heads may remain in a substantially stationary position in the well, while the axial position of the packer mandrel is determined as a function of the expansion and contraction of the tubular string in response to temperature changes.

These and further features and advantages of the present invention will become apparent from the following detailed description, wherein reference is made to the figures in the accompanying drawings.

DETAILED DESCRIPTION OF PREFERRED EMBODIMENTS

Figure 1:
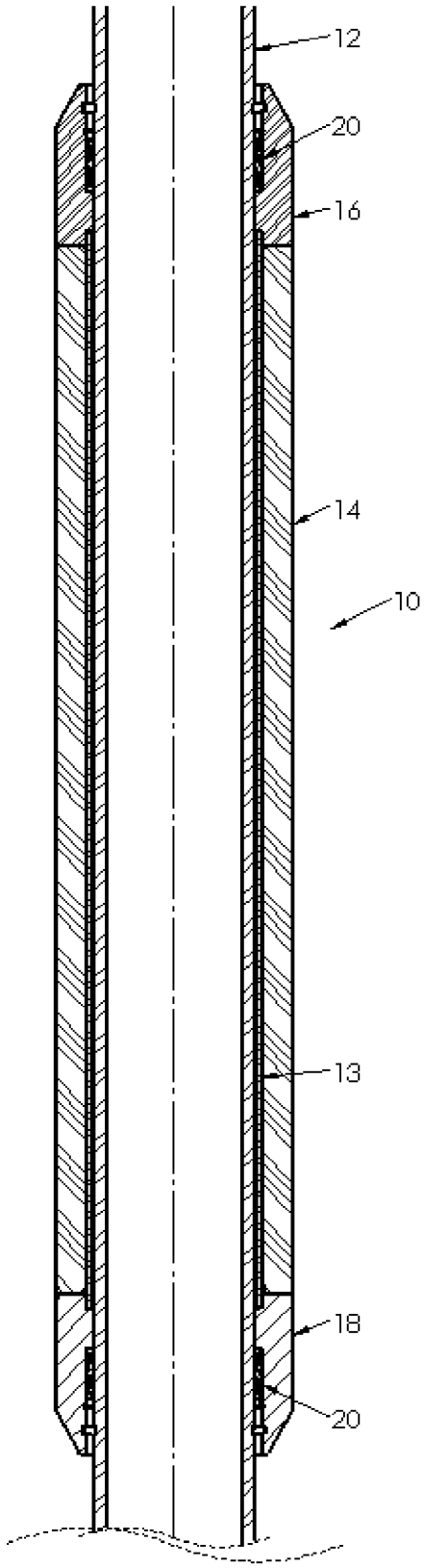
FIG. 1 is a cross-sectional view of a high temperature packer according to the present invention.

FIG. 1 discloses one embodiment of a high temperature packer 10 for positioning in a well on a tubular string. The tubular string may be interconnected with the packer mandrel 12 by conventional threads. An elastomeric packer body 14 is positioned circumferentially about the mandrel 12 and is radially expandable to seal an annulus about the packer mandrel, whether in open hole or within a casing. For the specific embodiment of a high temperature packer 10 as shown in FIG. 1, the packer body 14 is an inflatable packer, such that fluid pressure within the interior of the mandrel 12 inflates the packer body 14 to the set position. Connecting tube 13 spaced between mandrel 12 and packer body 14 interconnects the packer heads 16, 18, e.g., by welding to an end of tube 13. In other embodiments, however, the packer may be mechanically set so that compressive forces expand the packer body to seal the annulus. The technique of the present invention is thus applicable to various types of downhole packers, and various mechanisms may be used to radially expand the packer body, including swellable packers, fluid reactive packers, inflatable packers, and mechanical compression set packers.

The packer 10 includes an upper packer head 16 secured to an upper end of the packer body 14, and a lower packer head 18 secured to a lower end of the packer body. Seal stack 20 is provided for sealing between each packer head and the mandrel 12, and is retained by retainer ring 22.

Figure 2:
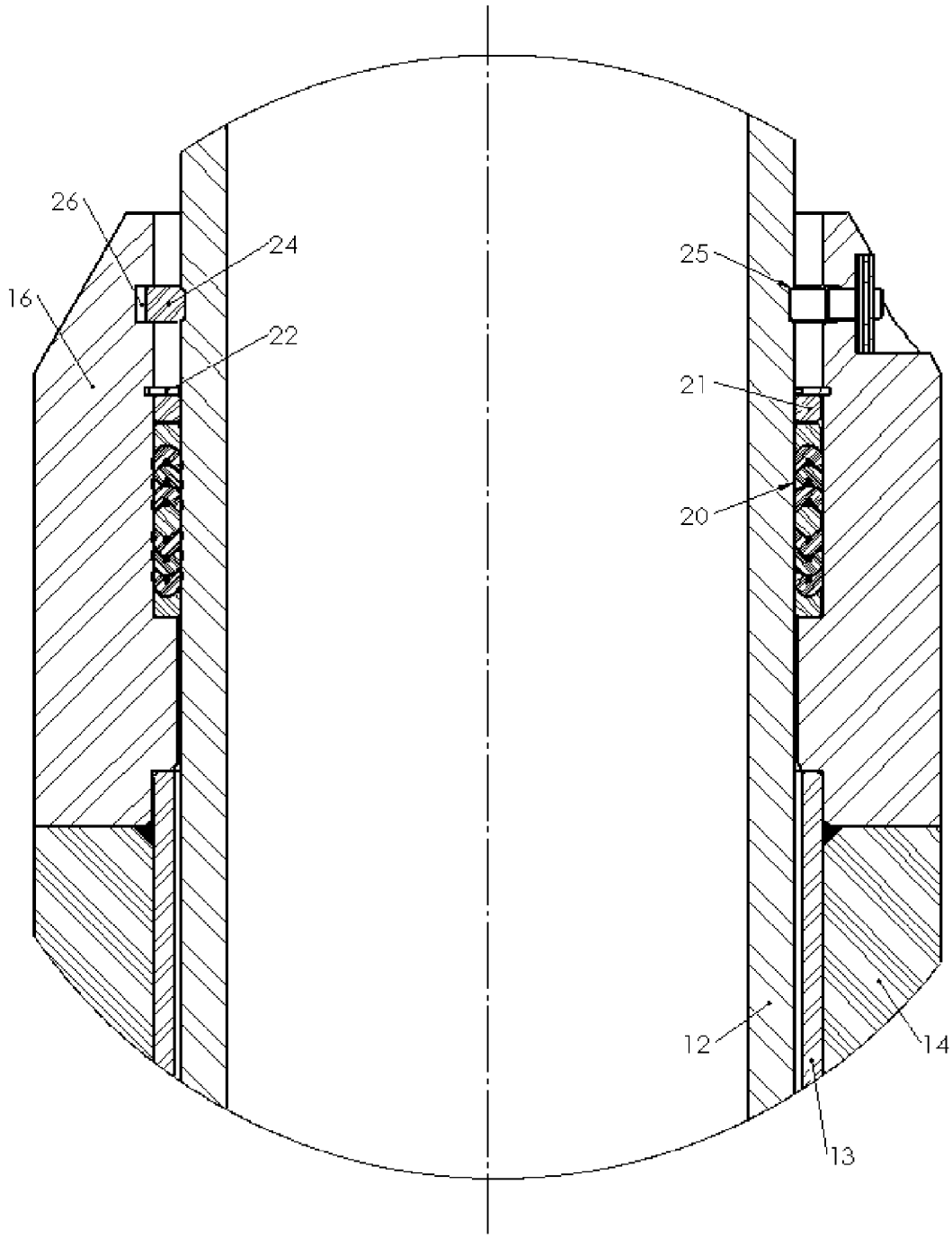
FIG. 2 is a cross-sectional view of a packer head secured to a mandrel.

Referring now to FIG. 2, more details of the upper packer head 16 and the seal stack 20 are shown. A seal stack preferably is provided since at least two seals will always be in sealing contact with the mandrel as it moves relative to the packer body, even when the seal stack moves past the groove 28. A C-ring 22 is shown positioned within groove 26 in the packer head 16, and also within a receiving groove 28 in the packer mandrel 12. The C-ring 24 is an outwardly biased C-ring, but is retained in its radially inward position so that the inward portion of C-ring 24 fits within the groove 28, thereby axially interconnecting the packer head to the mandrel. This allows the packer to be positioned at a known axial position along the mandrel and thus along the tubular string when run and set in the well. A scraper ring 21 is provided axially above or below the respective seal stack, and is axially sized to scrape deposits from the outside of the mandrel, which are prevalent in high temperature steam applications.

After the packer is set, a subsequent temperature increase in the well will raise the temperature of the tubular string, thereby axially expanding the tubular string. When the temperature rises to a sufficient value, the temperature responsive member discussed subsequently will fail, thereby allowing separation of the ends of the C-ring 24 and thus radially outward expansion of the outwardly biased C-ring, such that failure of the temperature responsive member causes the C-ring to move out of the groove 28 and radially outward into the receiving groove 26, thereby axially disconnecting the packer head 16 from the mandrel 12. This axial separation of the packer head from the mandrel thus allows the packer body and the upper and lower packer head to remain in a substantially fixed axial position in the well, while the axial movement of the mandrel 12 due to elongation or contraction of the tubular string allows the mandrel to move relative to the set packer, thereby not destroying the function of the packer.

Figure 3:
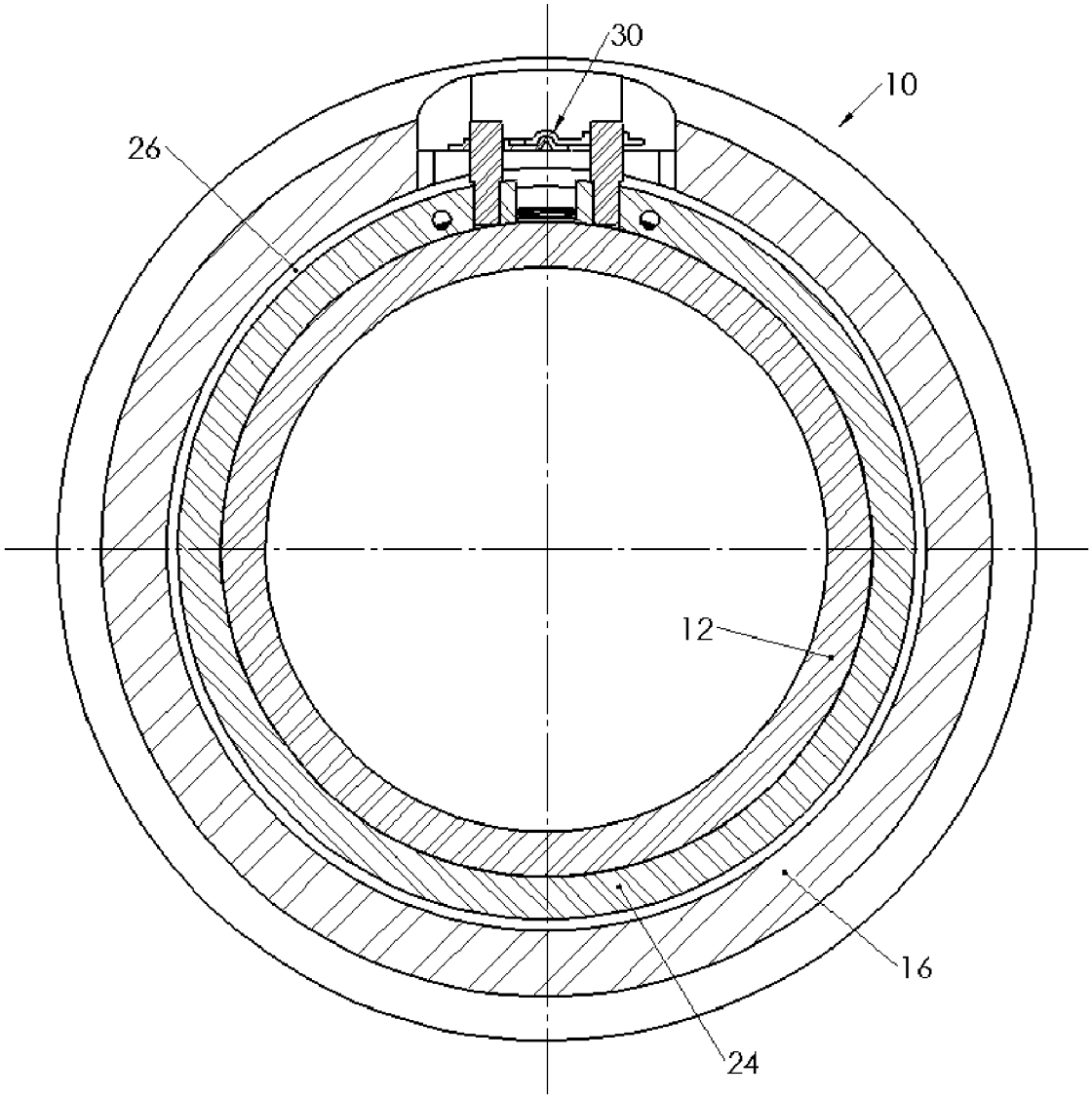
FIG. 3 is a cross-sectional view of a C-ring held in a radially compressed position by a high temperature link.

FIG. 3 is a cross-sectional view of a high temperature packer according to the present invention, with the cross-section taken through the temperature responsive member 30 and the C-ring 24 shown in FIG. 2. The ends of the C-ring 24 are thus normally held together by the high temperature responsive member 30, which is generally exposed to the temperature of the well fluids. When the temperature rises to a sufficient level, e.g., 380° F., the temperature responsive member 30 will automatically fail, thereby releasing the ends of the C-ring 24 and allowing the ends to circumferentially separate due to the radially outward bias of the C-ring. The separation of the ends of the C-ring 24 thus allows the C-ring to expand radially outward to move into the groove 26 shown in FIGS. 2 and 3, thereby releasing the packer head from the mandrel 12.

In a preferred embodiment, both the upper packer head and lower packer head may be provided with a C-ring and a temperature responsive member for releasing the respective C-ring, as explained above. In other cases, only one of the packer heads may be provided with such a C-ring and temperature responsive member. It is a feature of the invention that if a C-ring is provided, it is outwardly biased, since the disengaged C-ring may more readily fit within an arcuate groove in the packer head as compared to an arcuate groove in the mandrel.

A significant advantage of temperature responsive member which yields or fails as disclosed herein is that no significant risk is created that the seals between the packer head and the mandrel may be damaged during the releasing operation. In other words, if a shear pin were to axially interconnect the packer head and the packer mandrel, shearing of that pin would leave an edge which could damage the seals during axial travel above and below the sheared pin. No such risk is incurred with the temperature responsive member of the present invention.

While various types of temperature responsive members or fuses may be used, commercially available temperature responsive members that reliably separate at selected temperatures of from about 250° F. to about 450° F. are well known in the art, and various styles and configurations of these temperature responsive member may be employed. In a preferred embodiment, the temperature sensors are made from material which effectively separates at a high temperature, thereby releasing the connector to move to a disengaged position.

The method of the invention will become apparent from the foregoing description. A principal feature of the present invention is that the operator need not take any action to cause the packer head to become disengaged from the mandrel. In other words, no manipulation of the tubing string or other manipulation of the packer is required in order for the packer to desirably perform its mandrel releasing function. Once the packer is set in the well, the temperature of the formation surrounding the well and thus the temperature of the well itself may be increased significantly to enhance hydrocarbon production. This increase in temperature will cause axial elongation of the tubing string, and this axial elongation could destroy the packer body if the packer were fixed to the mandrel. According to the present invention, however, the packer head is automatically released from the mandrel by selecting a desired temperature responsive member. The operator will thus know what the temperature of the well will be raised to, and will also know how much of a temperature increase can occur before elongation of the tubular string will damage the set packer. By providing a temperature responsive member which operates below that range, the mandrel is allowed to move axially relative to the set packer body, with seals maintaining a fluid-tight seal between the packer head and the mandrel.

The temperature responsive member of the present invention is thus a member which is designed to fail at a selected temperature or temperature range, such that failure of the member causes the release of the connector between the packer head and the mandrel. The axial force required to shear a metal shear ring is, to a small extent, dependent upon the temperature of the shear ring, although the shear ring is not intended to fail or not fail as a function primarily of temperature. As previously discussed, such a shear ring between a packer head and a mandrel would also cause problems with a reliable seal between the packer head and the mandrel. The materials from which a temperature responsive member are manufactured do allow, however, alternatively for failure at a fairly low tensile strength. The C-ring 24 as disclosed herein may thus include radially inner upper an lower bevels, as shown in FIG. 2, so that an axial force imparted on the tubular string due to temperature elongation and contraction of the string will create a radially outward force on the C-ring 24, which translates to a tensile force across the temperature responsive member which, as shown in FIG. 3, retains the ends of the outwardly biased C-ring together. It is thus a feature of the invention to configure the connector, which is preferably a C-ring, and the temperature responsive member, so that a backup mechanism is available to cause the release. The temperature responsive member may thus alternatively yield at least in part due to an axial force imparted by mandrel movement to release the ends of the C-rings to move circumferentially apart to obtain a radially expanded C-ring position. This will then disengage the C-ring from the mandrel and allow the packer head to remain stationary while the mandrel is allowed to expand and contract axially with temperature changes. While the temperature responsive member may fail due to applied forces to the packer, it is primarily designed to fail in response to a specific temperature or temperature range.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A high temperature packer supported on a tubular string in a well, comprising:

a packer mandrel;

an elastomeric packer body positioned circumferentially about the mandrel and radially expandable to seal the annulus about the packer mandrel;

an upper packer head positioned about the mandrel and secured to an upper end of the packer body;

a lower packer head positioned about the mandrel and secured to a lower end of the packer body;

a connector for axially interconnecting at least one of the upper packer head and the lower packer head to the packer mandrel, the connector comprising a radially outwardly biased C-ring which is radially inwardly compressed for axially securing the packer head to the mandrel; and a temperature responsive member for maintaining the connector in position to secure the packer head to the mandrel until the temperature in the well rises to a level such that the temperature responsive member yields to allow the connector to release the radially outwardly biased C-ring to disconnect the packer head from the mandrel, the temperature responsive member connecting ends of the C-ring in a radially compressed C-ring position, and yielding to release the ends of the C-ring to move circumferentially apart to a radially expanded C-ring position, thereby disengaging the C-ring from the mandrel to allow the head to remain stationary while the mandrel expands and contracts axially with temperature changes.

2. A high temperature packer as defined in claim 1, wherein the packer body is set in an open hole.

3. A high temperature packer as defined in claim 1, wherein the packer body is set in casing.

4. A high temperature packer as defined in claim 1, further comprising:

a seal stack for maintaining a seal between the mandrel and the connected packer head.

5. A high temperature packer as defined in claim 1, further comprising:

a seal between the packer head and the mandrel; and a scraper ring to scrape deposits from the outside of the mandrel.

6. A high temperature packer as defined in claim 1, wherein the upper packer head has an upper connector and an upper temperature responsive member, and the lower packer head has a lower connector and a lower temperature responsive member.

7. A high temperature packer as defined in claim 1, wherein the temperature responsive member yields at least in part due to axial force imparted by mandrel movement to release the ends of the C-ring to move circumferentially apart to a radially expanded C-ring position, thereby disengaging the C-ring from the mandrel to allow the head to remain stationary while the mandrel is allowed to expand and contract axially with temperature changes.

8. A high temperature packer supported on a tubular string in a well, comprising:

a packer mandrel;

an elastomeric packer body positioned circumferentially about the mandrel and radially expandable to seal the annulus about the packer mandrel;

an upper packer head positioned about the mandrel and secured to an upper end of the packer body;

a lower packer head positioned about the mandrel and secured to a lower end of the packer body;

a connector for axially interconnecting at least one of the upper packer head and the lower packer head to the packer mandrel;

a C-ring for maintaining the connector in position to secure the packer head to the mandrel until the temperature in the well rises to a level such that a temperature responsive member yields to allow the connector to release the connected packer head from the mandrel, the temperature responsive member connecting ends of the C-ring in a radially compressed C-ring position, and yielding to release the ends of the C-ring to move circumferentially apart to a radially expanded C-ring position, thereby disengaging the C-ring from the mandrel to allow the head to remain stationary while the mandrel expands and contracts axially with temperature changes.

9. A high temperature packer as defined in claim 8, further comprising:

a seal stack between the mandrel and the connected packer head.

10. A high temperature packer as defined in claim 8, wherein the upper packer head has an upper connector and an upper temperature responsive member, and the lower packer head has a lower connector and a lower temperature responsive member.

11. A high temperature packer as defined in claim 8, wherein the temperature responsive member yields at least in part due to axial force imparted by mandrel movement to release the ends of the C-ring to move circumferentially apart to a radially expanded C-ring position, thereby disengaging the C-ring from the mandrel to allow the head to remain stationary while the mandrel is allowed to expand and contract axially with temperature changes.

12. A method of supporting a high temperature packer on a tubular string in a well, comprising:

securing a packer mandrel to the tubular string;

positioning an elastomeric packer body circumferentially about the mandrel;

positioning an upper packer head about the mandrel and secured to an upper end of the packer body;

positioning a lower packer head about the mandrel and secured to a lower end of the packer body;

axially interconnecting at least one of the upper packer head and the lower packer head to the packer mandrel with a radially outwardly biased C-ring which is radially inwardly compressed for axially securing the packer head to the mandrel; and radially expanding the packer body to seal the annulus about the packer mandrel;

providing a temperature responsive member for maintaining a connector in position to secure the packer head to the mandrel until the temperature in the well rises to a level such that the temperature responsive member yields to allow the connector to release the connected packer head from the mandrel, the temperature responsive member connecting ends of the C-ring in a radially compressed C-ring position, and yielding to release the ends of the C-ring to move circumferentially apart to a radially expanded C-ring position, thereby disengaging the C-ring from the mandrel to allow the head to remain stationary while the mandrel expands and contracts axially with temperature changes.

13. A method as defined in claim 12, wherein the packer body is set in an open hole.

14. A method as defined in claim 12, wherein the packer body is set in casing.

15. A method as defined in claim 12, further comprising:

maintaining a seal between the mandrel and the connected packer head.

16. A high temperature packer as defined in claim 12, wherein the temperature responsive member yields due to axial force imparted by mandrel movement to release the ends of the C-ring to move circumferentially apart to a radially expanded C-ring position, thereby disengaging the C-ring from the mandrel to allow the head to remain stationary while the mandrel is allowed to expand and contract axially with temperature changes.

* * * * *